US005681089A

United States Patent [19]

Lin

[11] Patent Number: 5,681,089

[45] Date of Patent: *Oct. 28, 1997

[54] DECK CHAIR ASSEMBLY

[76] Inventor: Steve Lin, No. 80, Kengtsai Ping, Hoping Village, Chuchi Hsiang, Chiayi Hsien, Taiwan

[ * ] Notice: The term of this patent shall not extend beyond the expiration date of Pat. No. 5,547,258.

[21] Appl. No.: 656,405

[22] Filed: May 31, 1996

Related U.S. Application Data

[63] Continuation-in-part of Ser. No. 455,842, May 31, 1995, Pat. No. 5,547,258.

[51] Int. Cl.[6] ..... A47C 4/02

[52] U.S. Cl. ..... 297/440.1; 297/440.22; 297/440.24; 297/377

[58] Field of Search ..... 297/440.1, 440.22, 297/440.24; 108/157, 180

[56] References Cited

U.S. PATENT DOCUMENTS

| | | | |
|---|---|---|---|
| 855,520 | 6/1907 | Margolin | 297/440.24 X |
| 4,299,423 | 11/1981 | Saiger | 297/440.24 |
| 4,784,436 | 11/1988 | Sutherland | 297/440.24 |
| 5,427,435 | 6/1995 | Yoder, Jr. | 297/440.24 X |
| 5,429,417 | 7/1995 | Kim | 297/440.22 X |

*Primary Examiner*—Peter R. Brown

*Attorney, Agent, or Firm*—Hedman, Gibson & Costigan, P.C.

[57] ABSTRACT

A deck chair assembly includes a first, at least one second and a third supporting member mounted on an underside of a body respectively. A first and a second L-shaped member each include a horizontal portion fitted in a first and a second end of the third supporting member respectively. A first positioning member includes a first outer sleeve mounted on a first leg of the first supporting member, at least one second outer sleeve mounted on a first leg of the second supporting member, and a third outer sleeve mounted on a vertical portion of the first L-shaped member. A second positioning member includes a fourth outer sleeve mounted on a second leg of the first supporting member, at least one fifth outer sleeve mounted on a second leg of the second supporting member, and a sixth outer sleeve mounted on a vertical portion of the second L-shaped member. A fastening device is mounted for securing the first, second and third outer sleeves to the first legs of the first and second supporting members and to the vertical portion of the first L-shaped member respectively, and securing the fourth, fifth and sixth outer sleeves to the second legs of the first and second supporting members and to the vertical portion of the second L-shaped member respectively.

4 Claims, 5 Drawing Sheets

DECK CHAIR ASSEMBLY

BACKGROUND OF THE INVENTION

The present invention refers to a Continuation-In-Part Application of the Applicant's U.S. Ser. No. 08/455,842, filed on May 31, 1995, now U.S. Pat. No. 5,547,258 issued Aug. 20, 1996.

FIELD OF THE INVENTION

The present invention relates to a deck chair assembly.

SUMMARY OF THE INVENTION

In accordance with one aspect of the present invention, there is provided a deck chair assembly comprising a body which includes a first end portion, a mediate flat portion and a second end portion. A first supporting member is fixedly mounted on an underside of the first end portion of the body. At least one second supporting member is fixedly mounted on an underside of the mediate end portion of the body. A third supporting member is fixedly mounted on an underside of the second end portion of the body.

A first L-shaped member includes a horizontal portion fitted in a first end of the third supporting member. A second L-shaped member includes a horizontal portion fitted in the second end of the third supporting member.

A first positioning member includes a first outer sleeve mounted on a first leg of the first supporting member, at least one second outer sleeve mounted on a first leg of the second supporting member, and a third outer sleeve mounted on a vertical portion of the first L-shaped member. A second positioning member includes a fourth outer sleeve mounted on a second leg of the first supporting member, at least one fifth outer sleeve mounted on a second leg of the second supporting member, and a sixth outer sleeve mounted on a vertical portion of the second L-shaped member.

A fastening device is mounted for securing the first, second and third outer sleeves to the first legs of the first and second supporting members and to the vertical portion of the first L-shaped member respectively, and securing the fourth, fifth and sixth outer sleeves to the second legs of the first and second supporting members and to the vertical portion of the second L-shaped member respectively.

In addition, a backrest includes a lower portion pivotably engaged with the second end portion of the body. A first wheel is rotatably mounted on the first positioning member, and a second wheel is rotatably mounted on the second positioning member.

Further features of the present invention will become apparent from a careful reading of the detailed description with reference to the accompanying drawings.

DETAILED DESCRIPTION OF THE PREFERRED EMBODIMENTS

Figure 1:
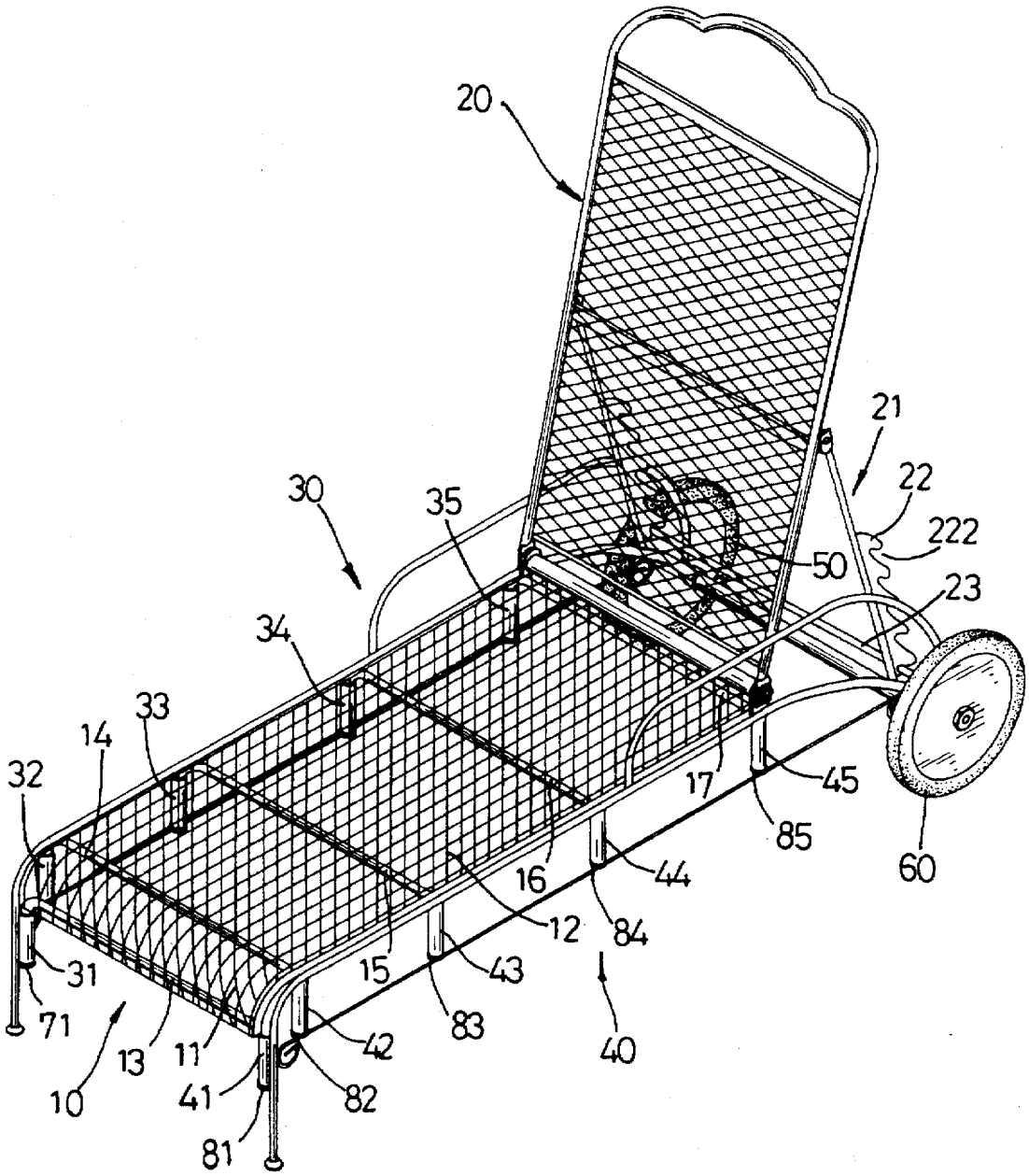
FIG. 1 is a perspective view of a deck chair assembly in accordance with the present invention.
Figure 2:
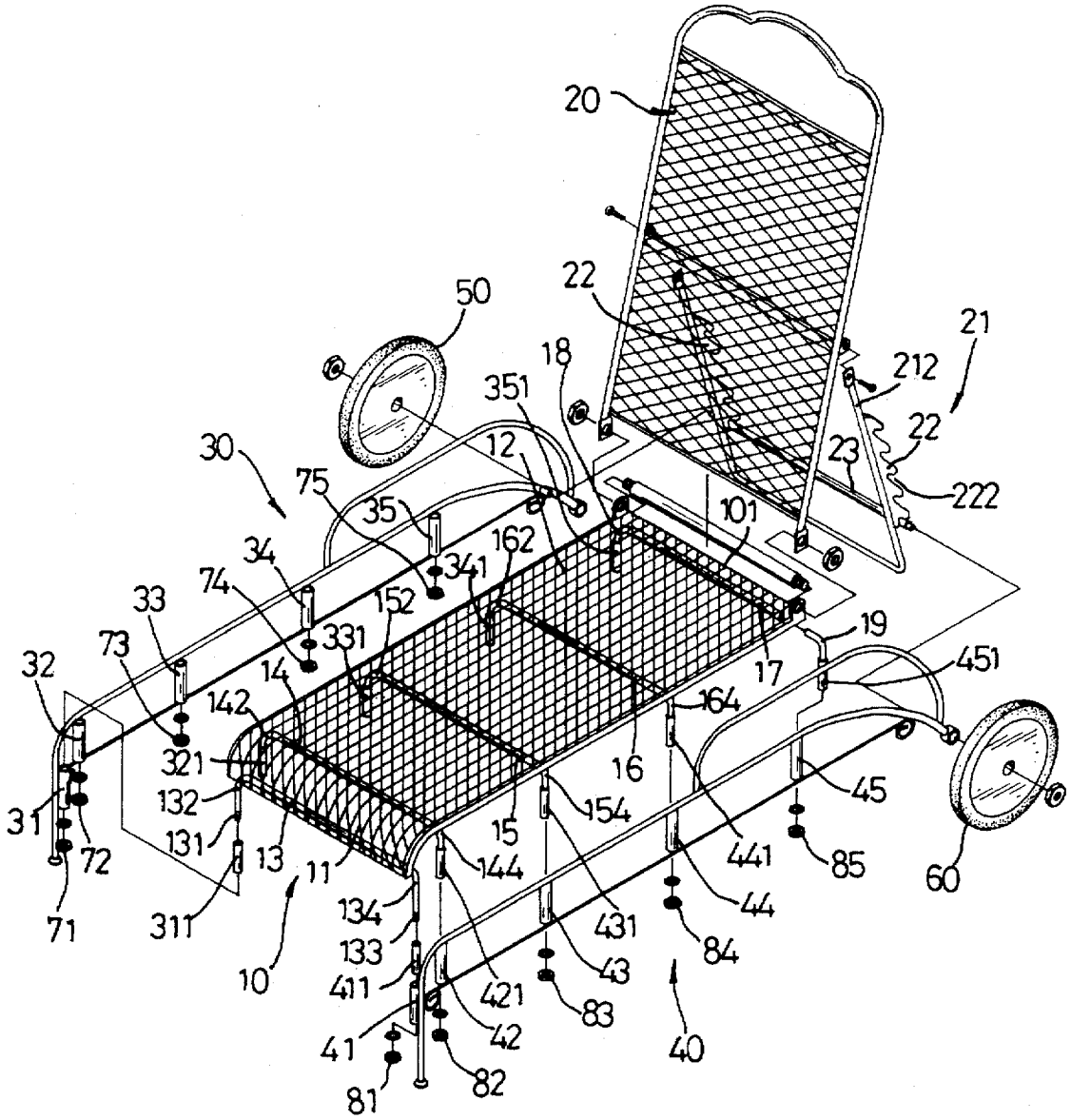
FIG. 2 is an exploded view of FIG. 1.

Referring to the drawings, and initially to FIGS. 1 and 2, a built-up deck chair assembly in accordance with the present invention comprises a body 10 including a first end portion 11, a mediate flat portion 12 and a second end portion 101. Preferably, the first end portion of the body 10 has an arcuate configuration.

A first supporting member 13 substantially inverted U-shaped in section is fixedly mounted on an underside of the first end portion 11 of the body 10 and includes a first leg 132 and a second leg 134 each having an outer thread 131 and 133.

Three second supporting members 14, 15, 16 being substantially inverted U-shaped in section are fixedly mounted on an underside of the mediate end portion 12 of the body 10 respectively and each include a first leg 142, 152, 162 each having an outer thread 141, 151, 161, and each include a second leg 144, 154, 164 each having an outer thread 143, 153, 163.

Figure 5:
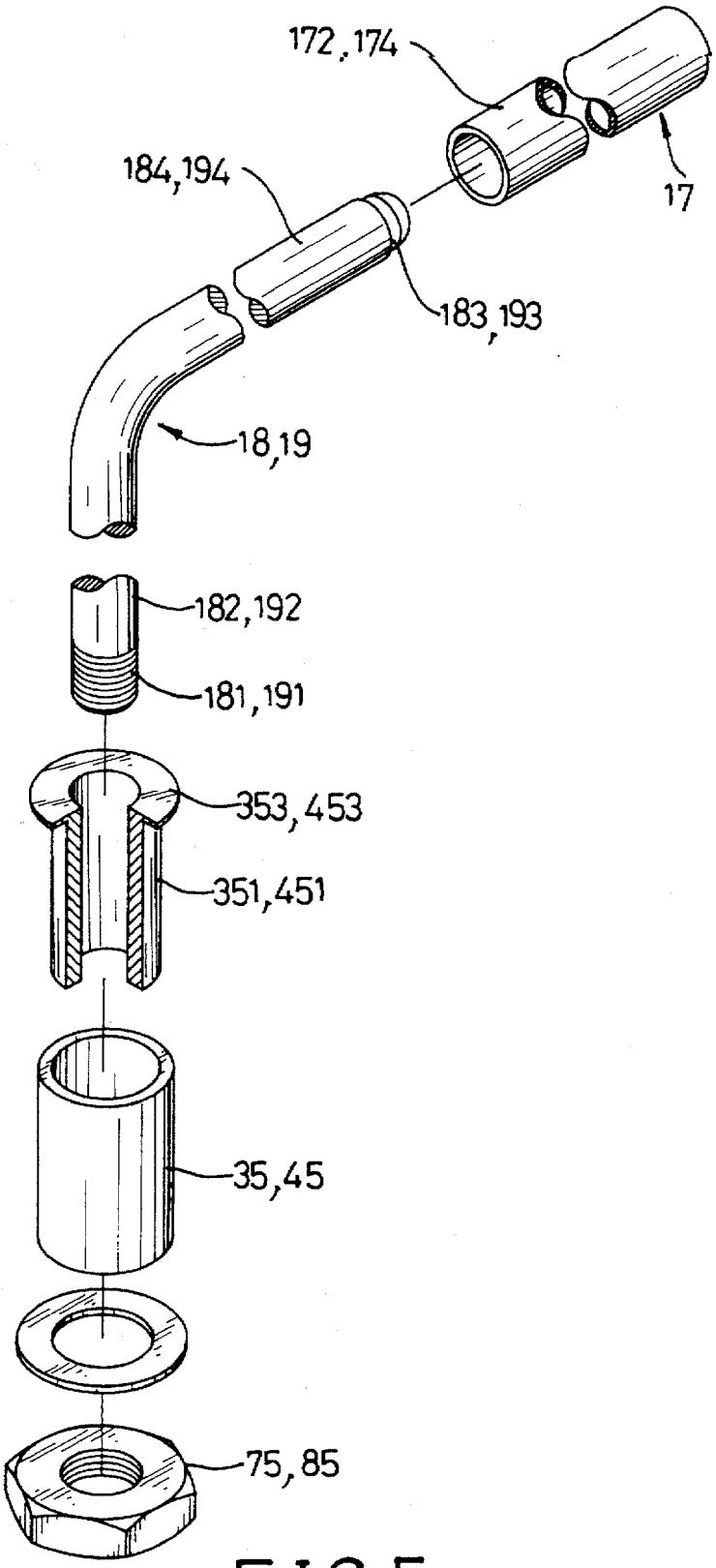
FIG. 5 is a partially cross-sectional exploded view showing a supporting member, an L-shaped member, an inner sleeve and an outer sleeve.

Referring to FIGS. 2 and 5, a third supporting member 17 is fixedly mounted on an underside of the second end portion 101 of the body 10 and includes a first end 172 and a second end 174. A first L-shaped member 18 includes a horizontal portion 184 fitted in the first end 172 of the third supporting member 17 and a vertical portion 182 with an outer thread 181. A second L-shaped member 19 includes a horizontal portion 194 fitted in the second end 174 of the third supporting member 17 and a vertical portion 192 with an outer thread 191.

Again referring to FIGS. 1 and 2 with reference to FIG. 5, a first positioning member 30 includes a first outer sleeve 31 mounted around the first leg 132 of the first supporting member 13, three second outer sleeves 32, 33, 34 mounted around the first legs 142, 152, 162 of the second supporting members 14, 15, 16, and a third outer sleeve 35 mounted around the vertical portion 182 of the first L-shaped member 18.

A second positioning member 40 includes a fourth outer sleeve 41 mounted around the second leg 134 of the first supporting member 13, three fifth outer sleeves 42, 43, 44 mounted around the second legs 144, 154, 164 of the second supporting members 14, 15, 16, and a sixth outer sleeve 45 mounted around the vertical portion 192 of the second L-shaped member 19.

Figure 3:
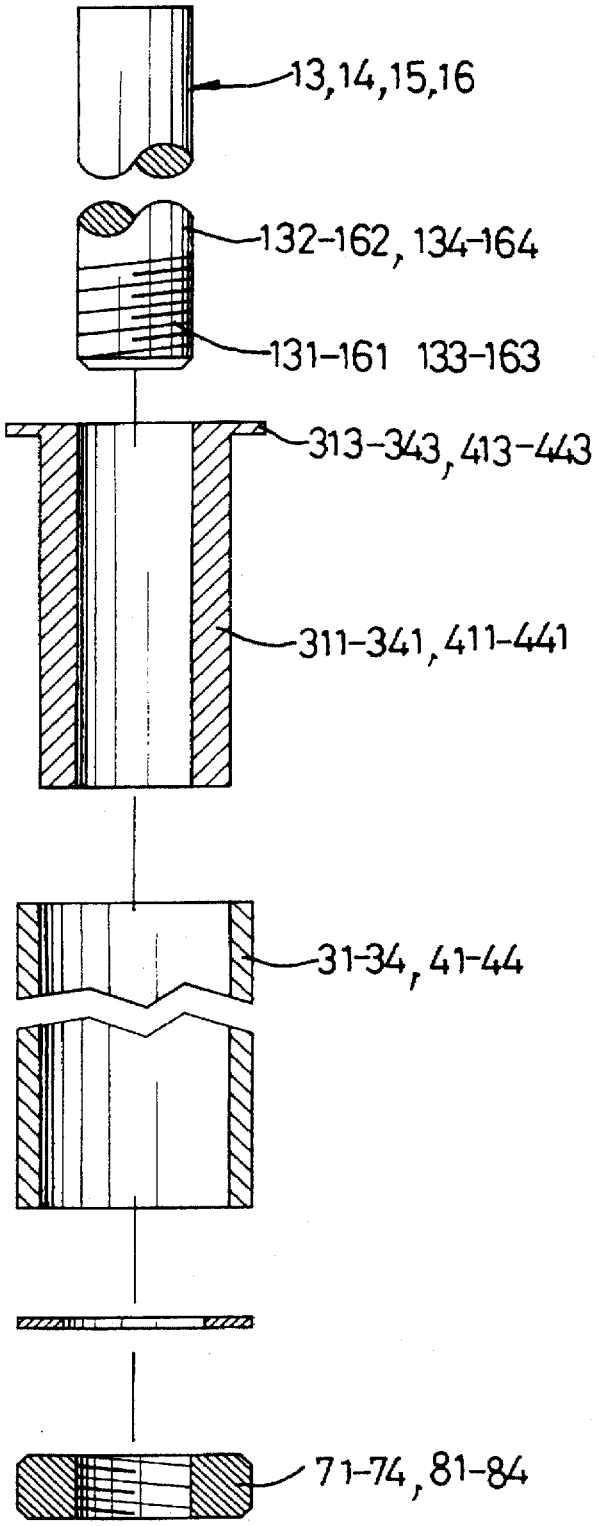
FIG. 3 is a cross-sectional view showing a supporting member, an inner sleeve and an outer sleeve disposed in an exploded status.
Figure 4:
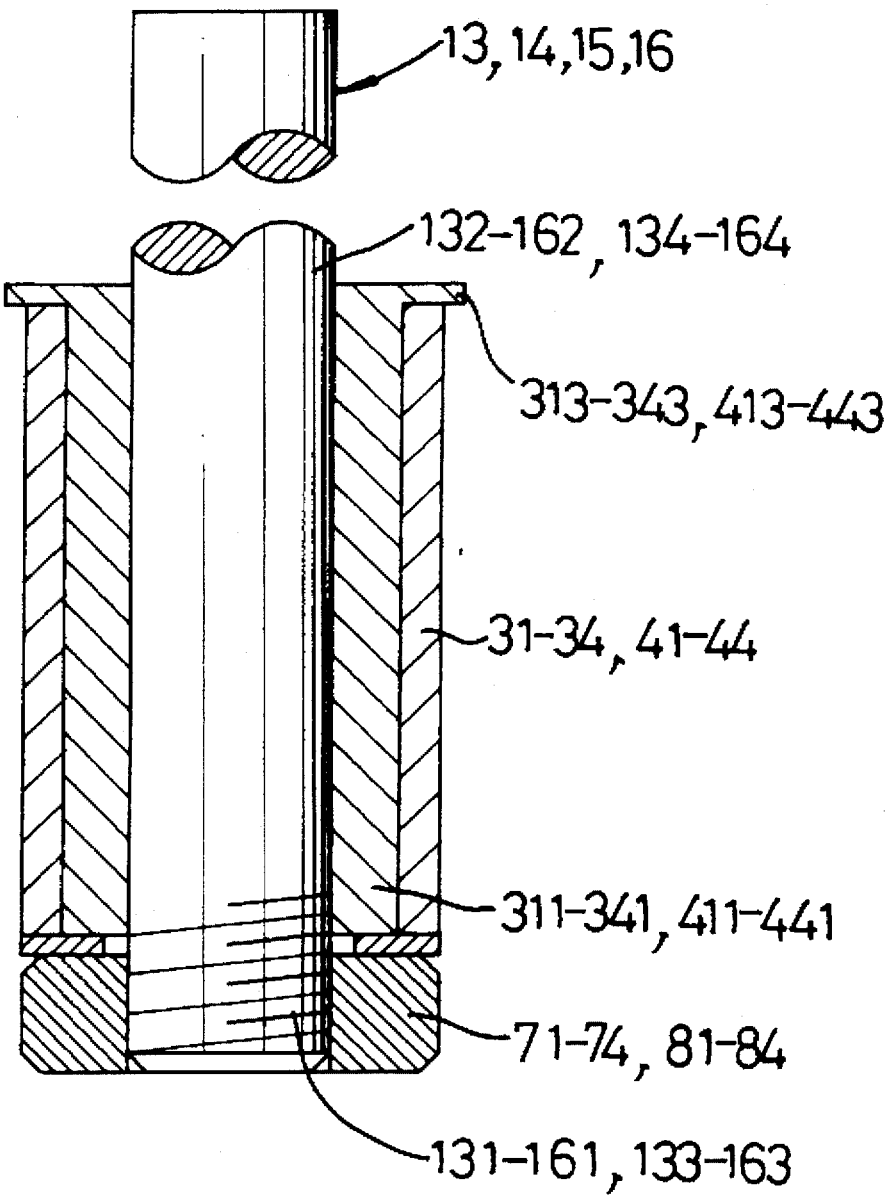
FIG. 4 is an assembly view of FIG. 3.

Referring to FIGS. 2–4, the first positioning member 30 further comprises four inner sleeves 311, 321, 331, 341 each respectively mounted between the first legs 132, 142, 152, 162 of the supporting members 13, 14, 15, 16 and the outer sleeves 31, 32, 33, 34. Similarly, the second positioning member 40 further comprises four inner sleeves 411, 421, 431, 441 each respectively mounted between the second legs 134, 144, 154, 164 of the supporting members 13, 14, 15, 16 and the outer sleeves 41, 42, 43, 44.

A fastening means comprises four positioning nuts 71, 72, 73, 74 each urged on the outer sleeves 31–34 and each threadedly mounted around the outer threads 131, 141, 151, 161 respectively, thereby retaining the first legs 132–162 of the supporting members 13–16 in the associated inner sleeves 311–341 respectively.

Similarly, the fastening means further comprises four positioning nuts 81, 82, 83, 84 each urged on the outer sleeves 41–44 and each threadedly mounted around the outer threads 133, 143, 153, 163 respectively, thereby retaining the second legs 134–164 of the supporting members 13–16 in the associated inner sleeves 411–441 respectively.

Annular flanges 313, 323, 333, 343 are respectively formed on an outer periphery of the inner sleeves 311–341 and extend radially and outwardly therefrom for stopping upward movement of the outer sleeves 31–34, and annular flanges 413, 423, 433, 443 are respectively formed on an outer periphery of the inner sleeves 411–441 and extend radially and outwardly therefrom for stopping upward movement of the outer sleeves 41–44.

Again referring to FIG. 5, inner sleeves 351, 451 are mounted between the vertical portions 182, 192 of the L-shaped members 18, 19 and the outer sleeves 35, 45 respectively. Positioning nuts 75, 85 are each urged on the outer sleeves 35, 45 and are each threadedly mounted around the outer threads 181, 191 respectively, thereby retaining the vertical portion 182, 192 of the L-shaped members 18, 19 b in the associated inner sleeves 351, 451 respectively.

Annular flanges 353, 453 are respectively formed on an outer periphery of the inner sleeves 351, 451 for stopping upward movement of the associated outer sleeves 35, 45.

Annular grooves 183, 193 are respectively defined along an outer periphery of the horizontal portions 184, 194 of the L-shaped members 18, 19. Annular projections (not shown) are respectively formed on an inner periphery of the first and second ends 172, 174 of the supporting member 17 for being engaged in the associated grooves 183, 193, thereby retaining the horizontal portions 184, 194 of the L-shaped member 18, 19 in the supporting member 17.

Referring to FIG. 1 and 2, a backrest 20 includes a lower portion pivotably engaged with the second end portion 101 of the body 10. A crossbar 23 is fixedly mounted between the two positioning members 30 and 40. A reclining brace 21 substantially U-shaped in section includes two vertical posts 212 each pivotally engaged with a mediate portion of the backrest 20 and each having an adjusting member 22 formed thereon. The adjusting member 22 has a plurality of notches 222 defined therein for being detachably engaged with the crossbar 23.

In assembly, referring to FIGS. 1–2 with reference to FIGS. 3–5, the inner sleeves 311–341 and 411–441 are respectively fitted around the associated legs 132–162 and 134–164 of the supporting members 13–16. The horizontal portions 184, 194 of the L-shaped members 18, 19 are fitted in the supporting member 17 respectively and the inner sleeves 351, 451 are fitted around the vertical portions 182, 192 of the L-shaped members 18, 19 respectively.

The positioning members 30, 40 are then attached to the body 10 with the outer sleeves 31–35 and 41–45 thereof being fitted around the associated inner sleeves 311–351 and 411–451.

Then, the positioning nuts 71–75 and 81–85 are threadedly mounted around the outer threads 131–161, 181, and 133–163, 191 respectively, thereby positioning the supporting members 13–17 by means of the two positioning members 30, 40 and the positioning nuts 71–75 and 81–85.

The backrest 20 is subsequently pivotally attached to the body 10 and the crossbar 23 is fitted between the two positioning members 30, 40. The reclining brace 21 is pivotally attached to the backrest 20 with the two adjusting members 22 resting on the crossbar 23, thereby easily adjusting the tilting level of the backrest 20 by means of detachable engagement between the plurality of notches 222 of the adjusting members 22 and the crossbar 23.

Finally, the two wheels 50, 60 are rotatably mounted on the two positioning members 30, 40 respectively, thereby accomplishing the assembling of the deck chair assembly.

What is claimed is:

1. A deck chair assembly comprising:

a body (10) including a first end portion (11), a mediate flat portion (12) and a second end portion (101);

a first supporting member (13) substantially inverted U-shaped in section being fixedly mounted on an underside of the first end portion (11) of said body (10) and including a first leg (132) and a second leg (134);

at least one second supporting member substantially inverted U-shaped in section being fixedly mounted on an underside of the mediate end portion (12) of said body (10) and including a first leg and a second leg;

a third supporting member (17) fixedly mounted on an underside of the second end portion (101) of said body (10) and including a first end (172) and a second end (174);

a first L-shaped member (18) having a horizontal portion (184) fitted in the first end (172) of said third supporting member (17) and a vertical portion (182);

a second L-shaped member (19) having a horizontal portion (194) fitted in the second end (174) of said third supporting member (17) and a vertical portion (192);

a first positioning member (30) including a first outer sleeve (31) mounted on said first leg (132) of said first supporting member (13), at least one second outer sleeve mounted on said first leg of said second supporting member, and a third outer sleeve (35) mounted on said vertical portion (182) of said first L-shaped member (18);

a second positioning member (40) including a fourth outer sleeve (41) mounted on said second leg (134) of said first supporting member (13), at least one fifth outer sleeve mounted on said second leg of said second supporting member, and a sixth outer sleeve (45) mounted on said vertical portion (192) of said second L-shaped member (19); and fastening means for securing said first, second and third outer sleeves of said first positioning member (30) to said first legs of said first and second supporting members and to said vertical portion (182) of said first L-shaped member (18) respectively, and securing said fourth, fifth and sixth outer sleeves of said second positioning member (40) to said second legs of said first and second supporting members and to said vertical portion (192) of said second L-shaped member (19) respectively.

2. The deck chair assembly in accordance with claim 1, wherein said first supporting member (13) has a first outer thread (131) formed on the first leg (132) thereof and a second outer thread (133) formed on the second leg (134) thereof, said fastening means comprising a first positioning member (71) threadedly mounted around said first outer thread (131) and a second positioning member (81) threadedly mounted around said second outer thread (133).

3. The deck chair assembly in accordance with claim 1, wherein said second supporting member has a first outer thread formed on the first leg thereof and a second outer thread formed on the second leg thereof, said fastening means comprising a first positioning member threadedly mounted around said first outer thread and a second positioning member threadedly mounted around said second outer thread.

4. The deck chair assembly in accordance with claim 1, wherein said first L-shaped member (18) has a first outer thread (181) formed on the vertical portion (182) thereof, and said second L-shaped member (19) has a second outer thread (191) formed on the vertical portion (192) thereof, said fastening means comprising a first positioning member (75) threadedly mounted around said first outer thread (181) and a second positioning member (85) threadedly mounted around said second outer thread (191).

* * * * *